US010731386B2

(12) United States Patent
Mittelbach

(10) Patent No.: US 10,731,386 B2
(45) Date of Patent: Aug. 4, 2020

(54) LOCK FOR A MOTOR VEHICLE

(71) Applicant: Kiekert Aktiengesellschaft, Heiligenhaus (DE)

(72) Inventor: Stephan Mittelbach, Velbert (DE)

(73) Assignee: Kiekert AG, Heiligenhaus (DE)

( * ) Notice: Subject to any disclaimer, the term of this patent is extended or adjusted under 35 U.S.C. 154(b) by 1021 days.

(21) Appl. No.: 15/120,197

(22) PCT Filed: Feb. 5, 2015

(86) PCT No.: PCT/DE2015/000042

§ 371 (c)(1),
(2) Date: Aug. 19, 2016

(87) PCT Pub. No.: WO2015/124130

PCT Pub. Date: Aug. 27, 2015

(65) Prior Publication Data

US 2017/0074004 A1 Mar. 16, 2017

(30) Foreign Application Priority Data

Feb. 19, 2014 (DE) ..... 10 2014 002 168

(51) Int. Cl.
*E05B 77/06* (2014.01)

(52) U.S. Cl.
CPC ..... *E05B 77/06* (2013.01)

(58) Field of Classification Search
CPC .... E05B 77/04; E05B 77/06; Y10T 292/1082; Y10T 292/1047; Y10T 292/57; Y10S 292/22; Y10S 292/23
USPC ..... 292/201, 216, 336.3, DIG. 22, DIG. 23
See application file for complete search history.

(56) References Cited

U.S. PATENT DOCUMENTS

| | | | | |
|---|---|---|---|---|
| 3,799,596 A * | 3/1974 | Nozomu | ..... | E05B 77/06 292/216 |
| 9,611,676 B2 * | 4/2017 | Bendel | ..... | E05B 77/06 |
| 9,732,544 B2 * | 8/2017 | Wittelsbuerger | ..... | E05B 77/06 |
| 2018/0195315 A1 * | 7/2018 | Mozola | ..... | E05B 85/10 |

(Continued)

FOREIGN PATENT DOCUMENTS

| | | |
|---|---|---|
| DE | 16 78 024 B1 | 8/1971 |
| DE | 19624640 C1 | 1/1998 |
| DE | 19738492 A1 | 3/1998 |

(Continued)

OTHER PUBLICATIONS

International Search Report for corresponding Patent Application No. PCT/DE2015/000042 dated Jul. 28, 2015.

*Primary Examiner* — Christine M Mills
(74) *Attorney, Agent, or Firm* — Renner, Otto, Boisselle & Sklar, LLP

(57) ABSTRACT

The invention relates to a lock for a motor vehicle, comprising an external actuating lever (2), an inertial element (3), and a detent lever (4) which is preloaded by a spring element (6) and rotatably mounted on the inertial element (3), wherein said detent lever (4) is able to cooperate with a blocking contour arranged on a housing of the lock, wherein the external actuating lever (2) acts directly on the detent lever (4) and wherein a movement of the external actuating lever (2) can be blocked by an inertia of the inertial element (3) and the external actuating lever (2) cooperates with the detent lever (4) by way of a control contour (9).

8 Claims, 2 Drawing Sheets

(56) References Cited

U.S. PATENT DOCUMENTS

Figure 1:
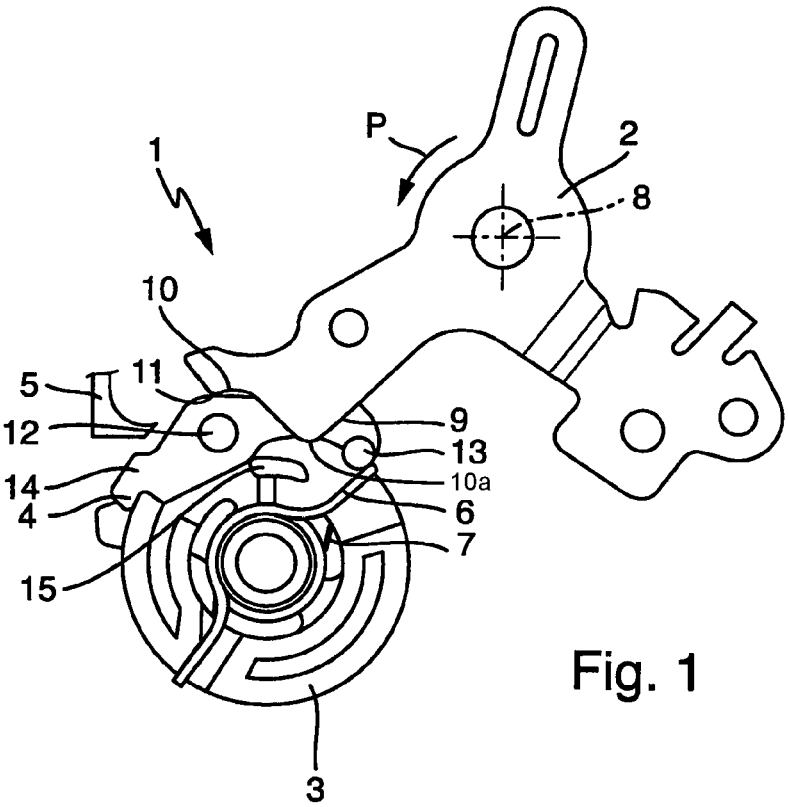

2018/0355641 A1* 12/2018 Kothe ..... E05B 81/16

FOREIGN PATENT DOCUMENTS

| | | | |
|---|---|---|---|
| DE | 19803871 | A1 | 8/1999 |
| DE | 102008036356 | A1 | 12/2009 |
| DE | 202009017667 | U1 | 5/2011 |
| DE | 10 2011 100090 | A1 | 10/2012 |
| EP | 0 215 702 | A1 | 3/1987 |
| EP | 1241305 | A1 | 9/2002 |
| EP | 2636827 | A2 | 9/2013 |

* cited by examiner

LOCK FOR A MOTOR VEHICLE

This application is a national phase of International Application No. PCT/DE2015/000042 filed Feb. 5, 2015, which claims priority to German Patent Application No. 10 2014 002 168.8 filed Feb. 19, 2014.

The invention relates to latch for a motor vehicle, comprising an external actuating lever, an inertial element and a detent lever, which is rotatably mounted on the inertial element and preloaded by a spring element and in which the detent lever can cooperate with a blocking contour arranged on a housing of the latch.

Motor vehicle latches and in particular latches for side doors, sliding doors, flaps or hoods generally contain a locking mechanism consisting of a catch and a pawl. In the closed state of the latch, the rotary movement of the catch is prevented by the pawl. A triggering lever can be provided for opening the locking mechanism, said lever acting directly or indirectly on the pawl. A rotating movement of the triggering lever causes the pawl to disengage from the catch so that the catch is released and the latch opens. The triggering lever can thus be mechanically opened by means of an internal or external actuating lever or, in case of an electronically operated latch, by means of an electric drive. In particular where the locking mechanism and thus the latch are opened by mechanical means, a mechanical connection chain exists between an external actuating lever and the triggering lever. When the external actuating lever or the external handle is activated, this causes the external handle to move and thus the locking mechanism to open.

In the event of an accident, the external handle or the external actuating lever can be actuated so that the locking mechanism is released and the latch is opened. In order to prevent unintentional opening of the locking mechanism, such as in the event of an accident, gravity based securing systems for latches are known. In such systems, inertial elements counteract the movement of the triggering lever and directly or indirectly prevent opening of the locking mechanism.

The unpublished document DE 10 2013 211 59.2 discloses, for instance, a side door latch in which opening of the locking mechanism in the event of excessive acceleration of the external actuating handle, is prevented by an inertial element. For this purpose, a rotatable detent lever is arranged between the triggering lever and the pawl, said lever being mounted on an inertial element. When the external actuating handle and thus the triggering lever are quickly accelerated, the inertial element prevents opening of the locking mechanism by deflecting the detent lever secured on the inertial element and cooperating with the blocking contour. Movement of the triggering lever does thus not cause the locking mechanism to be opened.

The impulse-like forces that are generated in the event of an accident and act on the motor vehicle and thus on the external actuating lever, cannot be accurately predetermined. In particular, also two or more impulses acting on the motor vehicle and thus also a multiple actuation of the external actuating lever can occur. A multiple actuation of the external actuating lever also causes a multiple actuation of the triggering lever. This can result in the triggering lever triggering a sequence of impulses, on the blocking mechanism and/or the inertial blocking element. Such a sequence of impulse-like accelerations of the triggering lever is also referred to as "bouncing". During bouncing, there is a danger that due to the numerous pulses the inertial blocking element is disengaged, allowing the triggering lever to act on the locking mechanism, causing the latch to open.

It is therefore a task of the invention to provide a latch for a motor vehicle that also prevents unintentional opening of the locking mechanism in case of a multiple, impulse-like actuation. A further task of the invention is to provide a cost-effective and favorable design solution for an inertial blocking element.

In order to solve this task, the invention suggests a latch for a motor vehicle, comprising an external actuating lever, an inertial element, a rotatable detent lever secured on the inertial element by preloading of a spring element, in which the detent lever can cooperate with a blocking contour arranged on a housing of the latch, with the external actuating lever acting directly on the detent lever and with a movement of the external actuating lever being blockable by an inertia of the inertial element and the external actuating lever cooperating with the detent lever by means of a control contour. In particular the formation of a control contour on the triggering lever now offers the option to directly influence the pivoting behavior of the detent lever on the inertial element. In this arrangement, the control contour is directly formed on the triggering lever, thus providing a cost-effective solution, as well as offering the advantage that the inertial blocking element of the invention can be individually adapted to a latch to meet different requirements. So depending on the design of the control contour, i.e. depending on the angle from which the moments are exerted on the detent lever, an independent adjustment of the actuating force applied to the detent lever is possible. The control contour defines the form of the triggering lever at the engagement point to the detent lever. The profile of the control contour can thus control the course, speed of movement and the moment transferred to the detent lever.

In one embodiment of the invention, the inertial element is deflected by the control contour during a usual actuating speed of the external actuating lever. The control contour at the triggering lever is designed in such a way that the detent lever on the inertial element deflects the inertial element during a usual actuating speed of the external actuating handle or external actuating lever so that blocking of the triggering lever is prevented. Preferably, the detent lever fixed to the inertial element is preloaded by a spring element, acting on the detent lever in counterclockwise direction. Where the detent lever is actuated by the triggering lever, the detent lever acts on the spring element, thus deflecting the inertial element. A usual actuating speed is in this instance regarded as the speed at which the manual operation of the external actuating handle moves the external actuating handle.

Advantageously the control contour contains a radius. This control contour can influence the movement of the detent lever. If a radius is formed on the control contour, the radius and thus the profile allows engagement of the detent lever. The detent lever is preloaded by a spring element so that the detent lever follows the control contour on the triggering lever. Advantageously, the formation of a radius allows following of the movement of the detent lever rotatably fixed on the inertial element. And, in particular, following of the superimposed movement of the point of attack of the triggering lever along a circular path around the pivot point of the inertial element in order to produce a continuously even force exerted on the detent lever and a continuous rotating movement at the inertial element.

In a further embodiment of the invention, two surfaces of the control contour bordering the radius are essentially arranged perpendicular to each other. Where as a result of the formation of the control contour, continuous movement of the inertial element and thus opening of the locking mechanism can, on one hand, be achieved during normal, i.e. during the usual actuating speed of the triggering lever, the formation of an essentially rectangular area of the control contour provides the further advantage that, in the event of an accident, several points of engagement became available between the triggering lever and the detent lever and the inertial element. Apart from the essentially perpendicularly arranged control contour, the triggering lever preferably contains at least one further contour in form of a radius so that this extended contour of the triggering lever can engage in the inertial element. As a result, an additional point of engagement is achieved thus influencing the bouncing behavior. The multiple points of engagement also achieve higher retention forces and thus a reliable operation of the inertial blocking element.

In a further embodiment of the invention, the control contour cooperates with a guide pin describable as being cylindrical and arranged at the detent lever. Where the detent lever contains an elevation describable as being cylindrical, a defined introduction of the force or of the moment into the detent lever can be achieved. A cylindrical guide pin can advantageously follow the control contour with great accuracy, which benefits a defined adjustment of the introduction of force. In addition, the cylindrical shape of the guide pin reduces the friction area between the detent lever and triggering lever to a minimum, facilitating again a light actuation of the latch. The haptic behavior of the latch can thus be positively influenced.

A further advantage of the invention can be achieved if the detent lever contains a further extension starting from a pivot point of the detent lever and on the end opposite the guide pin with said extension cooperating with a blocking means. If the triggering lever is quickly accelerated, the triggering lever engages with a contour of the inertial element and thus prevents opening of the locking mechanism. Where an additional extension is provided on the detent lever this offers the option to also provide a blocking means for moving the inertial element. The extension can positively and frictionally interact with a blocking means. A frictional connection can, for instance consist of an opening in the blocking means and an elevation in the extension. Naturally the invention also covers other forms and designs of a frictional connection.

In an advantageous embodiment, the blocking means is a damping element, in particular an elastic damping means. Where the blocking means is a damping means, the impulse on the triggering lever can be advantageously elastically absorbed. Where in the event of an accident or excessive actuation of the triggering lever, the triggering lever impinges the inertial element this produces a pronounced haptic response for the operator as well as a noise. As the blocking means is a damping means, soft absorption of the impulse can be achieved. On one hand, the impulse can be absorbed by the elastic damping means and, on the other hand, a noise is prevented or at least dampened. An elastomeric plastic can, for instance, be used as elastic damping means.

In a further embodiment of the invention, the extension contains a contour. The formation of a contour at the end or in the area of the extension can, on one hand, provide a positive connection and can, on the other hand, influence the damping behavior. Where, for instance, several elevations are formed at the end of the extension and/or on the damping means, which in turn cooperate with an elastic damping means, a large impulse can be absorbed and at the same time, considerable frictional forces can be generated. Considerable frictional forces and/or high damping properties advantageously counteract bouncing.

It can also be advantageous if the contour includes a form of a tip with the tip directly cooperating with the damping element. A pointed contour offers the advantage that the extension can move deep into the damping element so that said damping element provides an optimum spring constant. When a strong impulse is exerted on the triggering element, the pointed end of the detent lever can move deeply into the damping element, whilst it moves less deep into the damping element when the impulse is less strong. This shows that a sequence of several impulses, as for instance generated in case of an accident, can be individually absorbed by a pointed contour and an elastic damping agent. This shape consequently adapts to the impulse behavior and advantageously prevents opening of the locking mechanism in the event of bouncing.

In a further embodiment of the invention, the triggering lever can be blocked by the inertial element and the detent lever in case of an excessive actuating speed and, in particular, in the event of an accident with, in particular, the detent lever engaging with the damping element. The actuating speed is decisive for the function of the inertial blocking means. If the triggering lever is moved past a certain acceleration, the force of the impulse suffices to deflect the detent lever. The inertia of mass of the inertial element counteracts this deflection, with the detent lever being moved against the spring element located on the inertial element. The spring constant has been chosen in such a way that the inertial element opposes the force of the spring. Consequently, the spring element fixed on the inertial element and cooperating with the detent lever is decisive for determining the level of acceleration at which the inertial blocking means commences to function.

Below, the invention is explained in detail with reference to drawings showing further advantageous embodiments and characteristics. The invention is, however, not restricted to the depicted examples of further developments and characteristics. Instead, the characteristics described in one or several figures and the aforementioned characteristics can be combined to provide further embodiments. It is also pointed out that the reference numbers shown in the figures do not restrict the scope of protection of the present invention but only refer to the details of example embodiments shown in the figures without these examples limiting the scope of the invention.

The figures show the following:

FIG. 1: shows a detailed side view of a inertial blocking means of an installed latch of a motor vehicle.

Figure 2:
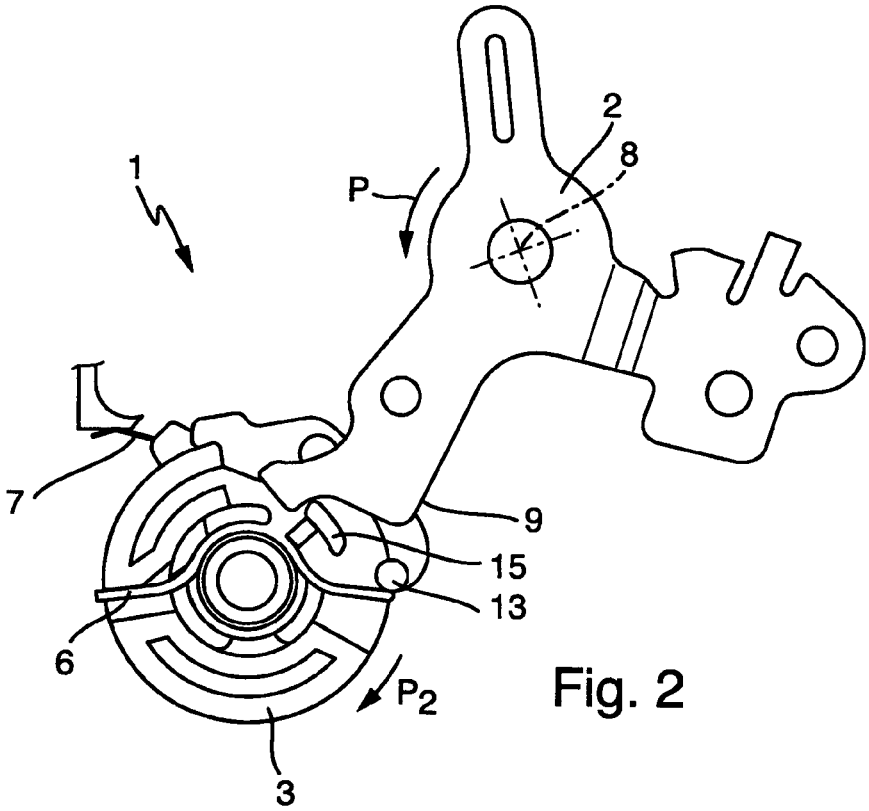
Figure 3:
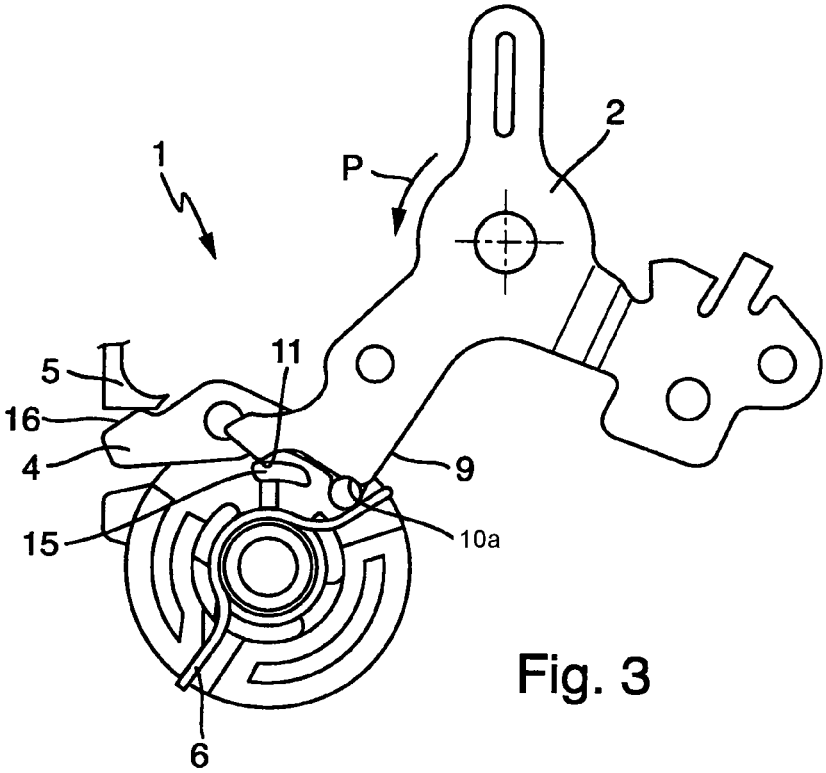

FIG. 2: shows the inertial blocking means of FIG. 1 at a normal actuation speed and FIG. 3: shows the inertial blocking means of FIG. 1 in the event of an increased acceleration of the triggering lever in a blocked state.

FIG. 1 shows a detached inertial blocking means 1 without the further components of a side door latch. FIG. 1 shows the triggering lever 2, the inertial blocking element 3, the detent lever 4, the damping means 5, the spring element 6 and a further spring element 7 in an arrangement in the latch in the non-actuated position. The triggering lever 2 is mounted in a latch in such a way that it is rotatable around an axis of rotation 8. By operating the external actuating lever and/or the internal actuating lever, neither of which is depicted, the triggering lever 2 can be moved around its axis 8 in counterclockwise direction and in the direction of arrow P. The triggering lever 2 contains a control contour 9, essentially comprising a radius 10, a right angle 10*a*, a radius 11 and an extension 11. The detent lever 4 is mounted on the inertial blocking element 3 in such a way that it is rotatable around an axis 12. The detent lever 4 comprises a cylindrical guide pin and an extension 14 that can engage with the damping element 5.

The inertial element 3 is also cylindrical, providing manufacturing advantages as well as a favorable design solution. The inertial element contains a stop contour 15 and also supports the first spring element 6 and the second spring element 7. The first spring element 6 holds the detent lever 4 in its resting position, abutting the inertial element 3. The second spring element 7 cooperates with the damping element or can abut the housing of the latch and stabilizes the position of the inertial element 3.

FIG. 1 shows a starting position with the latch in the resting position, i.e. for instance with the door closed and thus closed locking mechanism. The triggering lever 2 is disengaged from the detent lever 4. The force of the spring holds the detent lever against the inertial element 3 and the inertial element 3 is held in its starting position by the force of the spring.

FIG. 2 shows the inertial blocking means 1 in the position in which the triggering lever 2 was pivoted counterclockwise around its axis of rotation 8 in the direction of the arrow. If the triggering lever 2 is actuated, the control contour 9 engages with the guide pin 13 and moves the inertial element 3 against the force of the spring 7 in clockwise direction, as shown by arrow P2. The strength of the spring element 6 is such that the inertial element is moved along. The figure shows the position in which the triggering lever 2 is fully deflected, i.e. the external or internal actuating lever has been fully pulled out. At the same time, the control contour and, in particular, the radius 10 engages with the stop contour 15 so that the inertial element 3 can be reliably moved. The locking mechanism is directly released by the triggering lever or indirectly by means of further levers and the latch is opened.

FIG. 3 shows the scenario in which the inertial blocking means 1 has been excessively accelerated so that the movement of the triggering lever 2 is blocked. The high movement of the triggering lever 2 causes the control contour and, in particular, the essentially rectangular design or the right angle 10*a* of the control contour 9 to deflect the detent lever 4 against the force of the leg spring 6 so that the detent lever 4 engages the damping means 5. Also, the movement of the triggering lever 2 is impeded by the stop contour 15. In particular, the extension 11 rests on the stop contour 15, preventing further pivoting of the triggering lever 2. Due to the elastic contact of the detent lever 4 with the damping means, bouncing, i.e. a repeat movement of the triggering lever and thus an unintentional opening of the locking mechanism can be prevented. The damping characteristics of the damping means advantageously affect a continuous movement of the triggering lever. At the same time, the high frictional resistance between the detent lever 4 and the damping means 5 prevents any displacement of the detent lever. Even though this embodiment only shows one tip 16 on the detent lever 4, also several tips arranged in succession can engage with the damping means 5 in the manner disclosed in the invention.

The invention claimed is:

1. A latch for a motor vehicle, comprising:
an external actuating lever,
an inertial element,
a detent lever which is preloaded by a spring element and rotatably mounted on the inertial element, and
a control contour arranged on a housing of the latch and formed as a damping element, wherein said detent lever is engageable with the control contour,
wherein during a normal actuating speed, the external actuating lever acts directly on the detent lever, and
wherein during an excessive actuating speed, the external actuating lever is configured to deflect the detent lever against a force of the spring element toward the control contour for elastic contact with the control contour to prevent displacement of the detent lever, and wherein the external actuating lever rests against a stop contour of the inertial element whereby a movement of the external actuating lever can be blocked by an inertia of the inertial element.

2. The latch for a motor vehicle, according to claim 1, wherein, in case of a usual actuation speed of the external actuating lever, the inertial element can be deflected by the control contour.

3. The latch for a motor vehicle, according to claim 1, wherein the control contour contains a radius.

4. The latch for a motor vehicle, according to claim 3, wherein two surfaces of the control contour bordering the radius, are essentially arranged perpendicularly to one another.

5. The latch for a motor vehicle, according to claim 1, wherein the control contour cooperates with a cylindrical guide pin being arranged at the detent lever.

6. The latch for a motor vehicle, according to claim 5, wherein the detent lever contains a further extension starting from a pivot point of the detent lever on an end opposite to the guide pin, said further extension cooperating with a blocking means.

7. The latch for a motor vehicle, according to claim 6, wherein the further extension contains a contour.

8. The latch for a motor vehicle, according to claim 7, wherein the contour contains the shape of a tip with the tip directly cooperating with the damping element.

* * * * *